US006585451B2

(12) United States Patent
Wynings

(10) Patent No.: US 6,585,451 B2
(45) Date of Patent: Jul. 1, 2003

(54) HYDRAULIC DRIVE SPLIT LAWN ROLLER

(76) Inventor: Ross Wynings, 7846 Sagamore Dr. N., Liverpool, NY (US) 13090

( * ) Notice: Subject to any disclaimer, the term of this patent is extended or adjusted under 35 U.S.C. 154(b) by 49 days.

(21) Appl. No.: 09/972,500

(22) Filed: Oct. 9, 2001

(65) Prior Publication Data

US 2003/0068201 A1 Apr. 10, 2003

(51) Int. Cl.[7] ..... E01C 19/24; E01C 19/26

(52) U.S. Cl. ..... 404/131; 404/132; 180/19.1

(58) Field of Search ..... 404/122, 131, 404/132, 117; 37/285; 172/42, 115, 116, 256; 180/19.1

(56) References Cited

U.S. PATENT DOCUMENTS

| | | | | | |
|---|---|---|---|---|---|
| 134,311 | A | * | 12/1872 | Provost | 404/132 |
| 1,532,843 | A | * | 4/1925 | Stubbs | 404/117 |
| 1,699,437 | A | * | 1/1929 | Killik | 404/125 |
| 2,549,182 | A | | 4/1951 | Ekenstam | 94/50 |
| 2,763,974 | A | | 9/1956 | Martin | 55/6 |
| 2,967,579 | A | * | 1/1961 | Howard | 180/19.1 |
| 3,052,167 | A | | 9/1962 | Beale | 94/50 |
| 3,309,972 | A | * | 3/1967 | Peters | 404/117 |
| 3,431,832 | A | * | 3/1969 | Lang | 404/117 |
| 3,737,243 | A | * | 6/1973 | Dresher | 404/122 |
| 4,208,151 | A | | 6/1980 | Cross | 404/122 |
| 4,732,507 | A | | 3/1988 | Artzberger | 404/117 |
| 4,964,753 | A | * | 10/1990 | Ciminelli et al. | 404/122 |
| 5,261,213 | A | | 11/1993 | Humphrey | 56/2 |
| 5,379,479 | A | * | 1/1995 | Nelson | 15/245.1 |
| 5,518,079 | A | | 5/1996 | Zvolanek | 180/19.1 |
| 6,189,305 | B1 | | 2/2001 | Wright et al. | 56/14.7 |
| 6,200,066 | B1 | | 3/2001 | Humphrey | 404/117 |

* cited by examiner

*Primary Examiner*—Gary S. Hartmann
(74) *Attorney, Agent, or Firm*—Bernhard P. Molldrem, Jr.

(57) ABSTRACT

A power lawn roller has a left roller drum and a right roller drum, both journalled side by side on the same axle and rotatable independently of one another. Left and right hydraulic drives provide motive power to the left and right roller drums, and each is capable of rotating the associated drum forward, reverse, or at intermediate speeds. Removable external weights are rack mounted on the frame of the unit. The operator can easily control the direction and speed, and the unit is capable of a zero-radius turn.

9 Claims, 3 Drawing Sheets

HYDRAULIC DRIVE SPLIT LAWN ROLLER

BACKGROUND OF THE INVENTION

This invention relates to lawn and landscaping equipment, and is more particularly directed to self-powered equipment for rolling or compacting soil. The invention is specifically directed to a walk-behind lawn roller that permits an operator to control the direction and speed of travel with great precision, and without risk of damage to existing lawn, pavement or soil.

There now exists a need for a convenient method for rolling down topsoil in preparation for laying down of a new lawn. A need exists for rolling flat existing lawns, as well. At the present time what exists for this purpose is a lawn roller that has to be pulled or dragged by hand, or a roller that has to be towed behind a tractor. Both of these techniques are slow and awkward, and are somewhat unworkable if the terrain is anything but flat. What is needed is a lawn roller that is easy to turn and move about on a yard or lawn, without having to be pushed, pulled, or towed. In order to work the soil in areas near trees, buildings, or other structures, the lawn roller should be turnable in a small a radius as possible, but without noticeable damage to the lawn. In addition, to increase the mobility of the unit between work sites, and to adjust the weight of the unit to a given application, a means of removable weighting or ballasting should be used, and the use of water filled drums should be avoided.

Some lawn and construction equipment now exists for rolling earth or topsoil, but these are not entirely suited for the purposes served by this invention. An example of an existing self-propelled lawn roller is described in Cross U.S. Pat. No. 4,208,151. In that example, there is only a single drum roller. There is no means for turning the roller or changing direction, except brute force applied to the handle bar. This construction limits the total width of the roller. Another walk-behind soil compactor is described in Artzberger U.S. Pat. No. 4,732,507, which employs a pair of drums journalled side by side on a drum frame. These drums are driven by a common gear drive, and thus both drums turns together.

Hydraulic drive mechanisms have recently been employed in walk-behind self-propelled lawn mowers, one example of which is described in Zvolanek U.S. Pat. No. 5,518,079. In these lawn mowers, there is a separate hydraulic drive motor associated with the drive wheel on each side of the mower, and the operator can control the speed and direction of travel by squeezing control levers on the handle. However, despite the longstanding need for an improved lawn roller, no one has yet been motivated to incorporate the drive mechanism of this type of lawn mower into a split drum lawn roller.

OBJECTS AND SUMMARY OF THE INVENTION

Accordingly, it is an object of the invention to provide an effective and efficient technique for rolling and flattening soil in preparation for laying a lawn, or for rolling and flattening an existing lawn.

It is another object to provide a an improved self-propelled lawn roller for lawn installation and maintenance, which may be employed at golf courses, athletic fields, or parks, and which may be used in lawn care for commercial and residential applications.

It is a further object to provide a lawn roller that may be of increased width, and which may be used without difficulty and without a need to pull, push or tow it.

It is a still further object to provide a lawn roller that can be turned in a zero radius turn without damage to the lawn.

It is still another object to provide a lawn roller in which weight can be added or removed, and which avoids having to carry water within the roller drums.

According to an aspect of this invention, a power lawn roller has two roller drums that share a common axis and are individually movable. There is a frame that carries a transverse axle, and a left roller drum and a right roller drum are both journalled, side by side, on the axle. An engine is mounted on the frame and powers separate left and right independent hydraulic drive mechanisms providing motive power to the left and right roller drums, respectively. The hydraulic drive mechanism are each capable of rotating the associated drum at a forward speed and at a reverse speed, and at any desired speed in between, including idle. The control handle assembly for the unit has left and right control handles or squeeze handles, each operatively coupled to the associated drive mechanism, and this permits the operator to control the rotation speed of each of the drums. Directional control is entirely at the discretion of the operator. This arrangement allows the operator to move the lawn roller in a forward, reverse, left, or right direction, with the lawn roller responding immediately to the operator's hand actions on the squeeze levers. The drums can be rotated in different directions at the same time, allowing the operator to spin the lawn roller at its own center. There is a rear balance wheel or caster that also serves to press down the narrow strip of earth that is left by the gap between the two drums.

In a preferred mode, the hydraulic drive includes left and right hydraulic motors, and a continuous web drive between each hydraulic motor and the respective drum roller. The web drive may be a chain and sprocket drive, or may be a timing belt drive, for example.

Instead of using water to add weight to the drums, there are external weights, e.g., "suitcase" weights, mounted removably on racks to the left and right of the engine above the drums and somewhat forward of the drum axis. These weights can be removed when not needed, for example, when using the lawn roller on very loose soil, or when loading the unit onto a truck.

The principle of this invention can be employed in an extra-wide roller, for example, more than 48 inches across.

The propulsion system may be a gasoline engine, or may be any other available power source.

The above and many other objects, features, and advantages of this invention will become apparent to persons skilled in the art from the ensuing description of a preferred embodiment, which should be considered in connection with the accompanying Drawing.

DETAILED DESCRIPTION OF A PREFERRED EMBODIMENT

Figure 1:
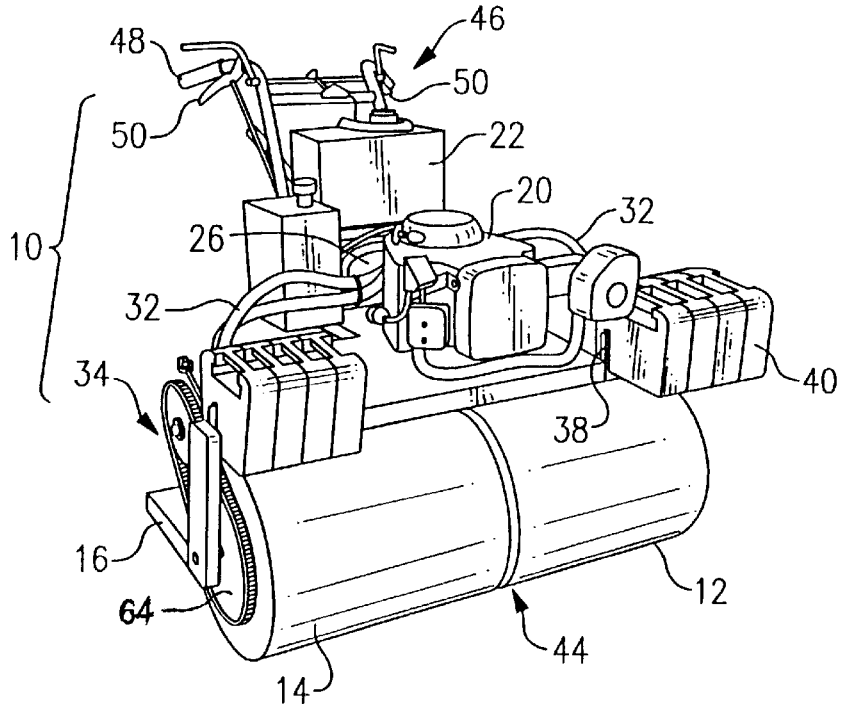
FIGS. 1, 2, and 3 are perspective view from the front right, rear right, and front left of a power lawn roller according to one embodiment of this invention.

With reference to the Drawing, and initially to FIGS. 1 to 4 thereof, one preferred embodiment of the split drum lawn roller 10 has a left roller drum 12 and a right roller drum 14, both situated on the same axis. A frame 16 has a central platform 18 on which a gasoline engine 20 is supported, with a fuel tank 22 situated above the engine 20. There are left and right hydraulic pumps 24 and 26 on the platform 18 and connected to the output shaft of the engine 20, and there are left and right hydraulic motors 28, 30 on the frame near the outboard ends of the drums, and these are connected by hydraulic hoses 32, 32 to the respective pumps 24, 26. At each end of the frame there is a chain drive 34, 34 for transferring rotary motion from the respective hydraulic motor to the associated roller drum 12, 14. While a chain drive is shown here, other continuous web drives may be employed, such as a toothed belt drive. Safety covers 36, shown on each side of the frame 16 in FIGS. 2 and 4, may be present over the upper sprocket of the chain drives. These are omitted in FIGS. 1 and 3 to reveal the chain drives and facilitate the explanation of this embodiment.

On the front of the frame, above the drums 12, 14 and ahead of their axis, are a pair of weight racks 38, which are elongated angle members each having an upstanding flange. There are a number of so-called "suitcase" weights 40, which each have a notch or slot that seats them onto the respective weight rack 38. Each of these may weigh approximately 45 pounds, i.e., 20 kilograms. The weights 40 can be removed, as need be, to relieve some of the weight of the drum roller 10. By using the removable, external weights 40, the need to fill the drums with water or sand is avoided. Some of the weights 40 may be removed for use of the lawn roller 10 on soft soil, and all of them may be removed to facilitate loading the unit onto a truck or other transport.

Figure 2:
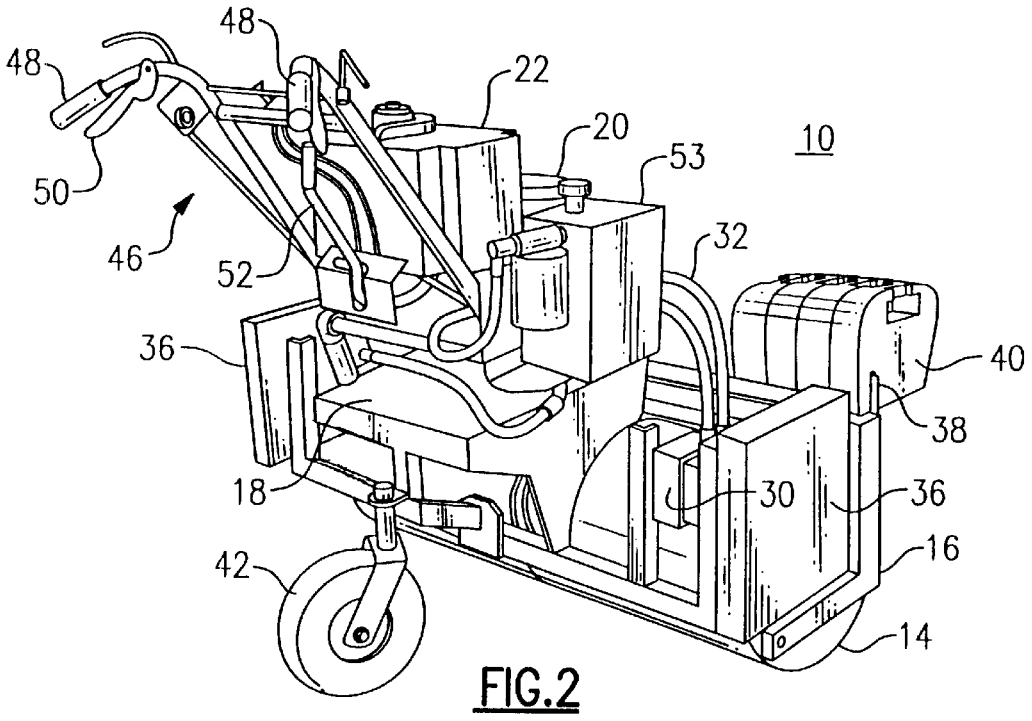
Figure 4:
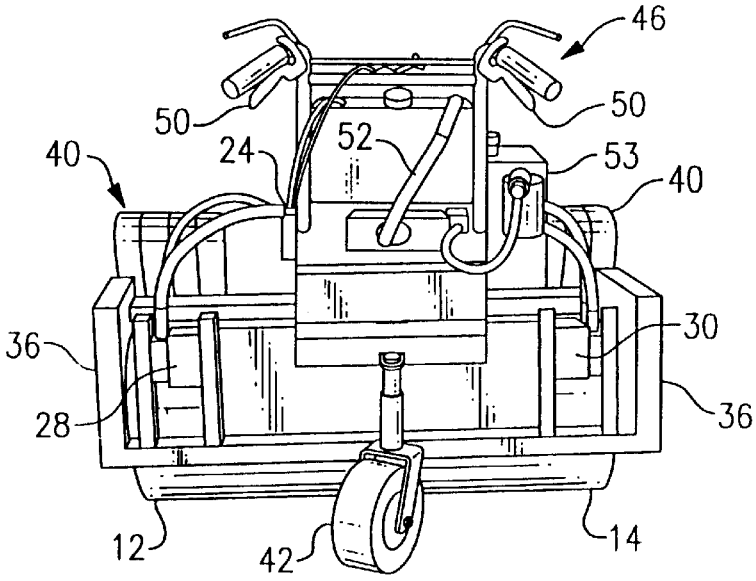
FIG. 4 is a rear perspective view of this embodiment.
Figure 3:
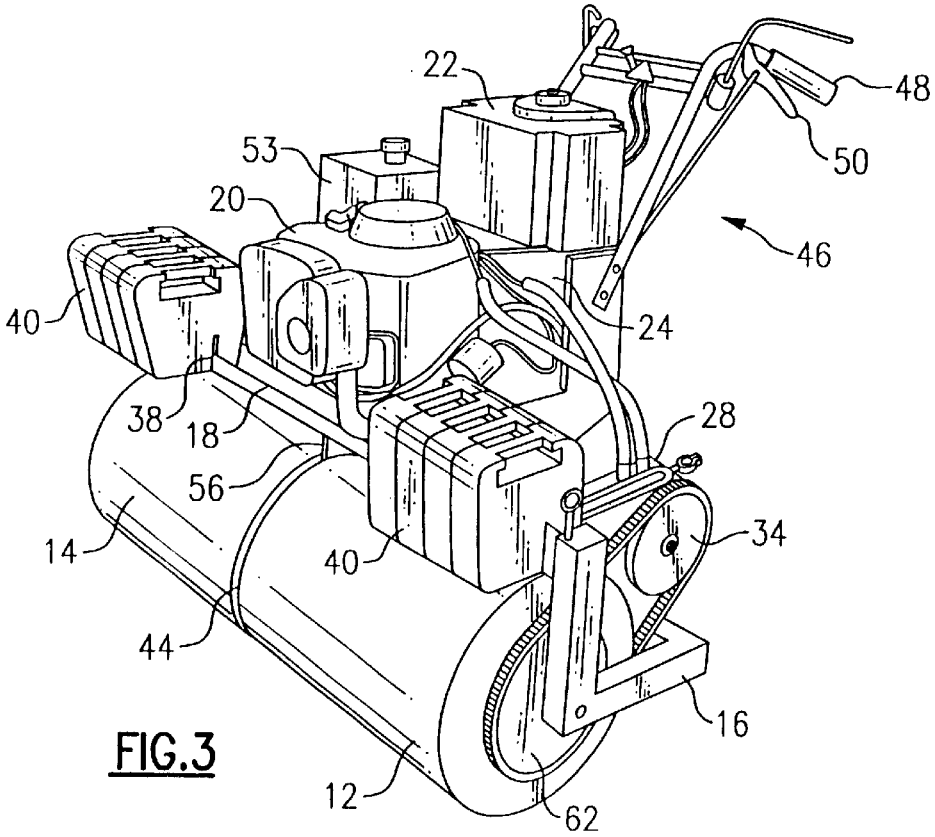

As shown in FIGS. 2 and 4, a caster rear wheel 42 is mounted centrally on the frame 16, and serves to balance the lawn roller 10. This can rotate about its vertical axis over 360 degrees, to permit the wheel 42 to follow the motion of the lawn roller, even in the case of a zero radius turn, which is to be described shortly. The castor wheel 42 has a tire that is generally flat across its width, with the width being about the same size or slightly greater that the size of the gap 44 between the two roller drums 12, 14. The wheel serves to press any narrow strip of earth or lawn that is left by the gap 44.

A handle bar assembly 46 is situated on the rear side of the frame 16, with hand grips 48 for the operator, and left and right squeeze levers 50, with linkages (not shown) that connect to the hydraulic pumps 24, 26, to permit the operator to control the direction and amount of flow through the hydraulic hoses 32 to the hydraulic motors 24, 26. This permits the operator to control the speed of rotation of each of the two drums 12, 14, independent of one another, anywhere between a full-forward speed, through null, to a full reverse speed. In this embodiment, the speeds are infinitely variable between full forward and full reverse, but in other embodiments, there be discrete intermediate speeds. Also, it is preferred that when the operator takes his or her hands from the squeeze levers, the speed revert to null, or not rotating.

Also shown in FIG. 2 an FIG. 4 is a motor control lever 52 and a tank or reservoir 53 for the system hydraulic fluid.

Figure 5:
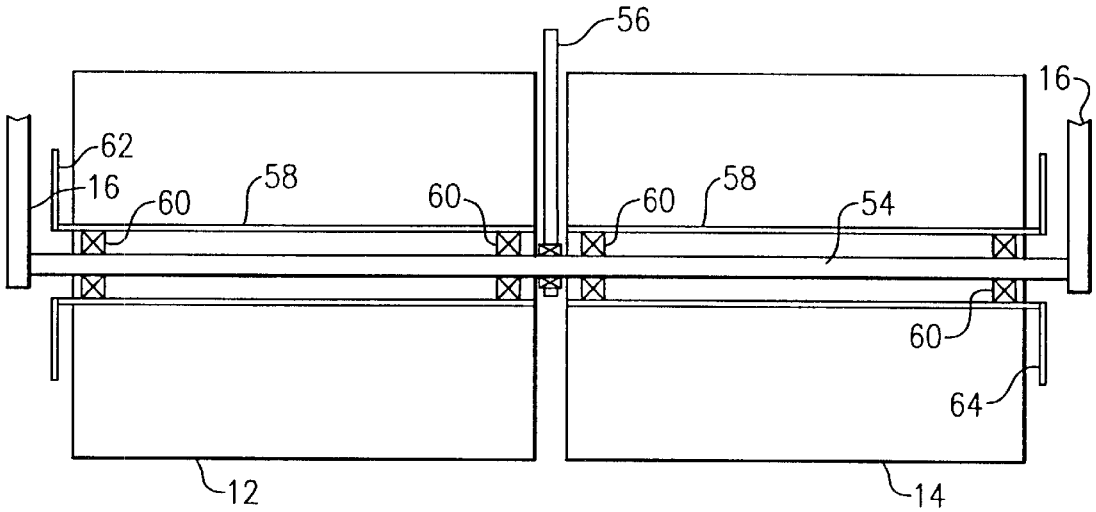
FIG. 5 is a schematic sectional view of a the drum rollers and axle of this embodiment.

The construction of the roller drums 12, 14 is shown in cross section in FIG. 5. An axle 54, e.g., a one-inch shaft, extends between sides of the frame, and is supported at its center by a center support brace 56 that extends into the gap 44 between the drums 12, 14. At the axis of each drum is a tubular core 58, e.g., a two-inch inside diameter member, that is journalled by means of bearings 60 onto the axle or shaft 54. Left and right drive sprockets 62, 64 for the respective chain drives 34, 34 are mounted on the outboard ends of the respective tubular core members 58, 58.

By squeezing up on both squeeze levers 50, 50, the operator causes the lawn roller 10 to move forward, i.e., straight ahead, and by pulling the levers down, the operator causes the lawn roller to back straight up. Steering is accomplished by squeezing one lever 50 more than the other so that the two drums 12, 14 turn at different speeds. By pulling up on one lever and squeezing the other down, the operator can cause one drum 12 to rotate forward and the other drum 14 to rotate reversely. This then causes the lawn roller 10 to spin about its center, i.e., to effect a zero-radius turn. The zero-radius turn carried out with this embodiment typically does not damage the lawn.

While the invention has been described in reference to a preferred embodiment, it should be understood that the invention is not limited to that precise embodiment. Rather, many modifications and variations will present themselves to those skilled in the art without departing from the scope and spirit of the invention, as defined in the appended claims.

I claim:

1. A walk-behind power Lawn roller that permits an operator walking behind it to control the direction and speed of travel with great precision; comprising a frame including a transverse axle; a left roller drum and a right roller drum both journalled side by side on said axle and rotatable independently of one another; a motor mounted on said frame above said roller drums; separate left and right independent drive means each powered by said motor and providing motive power to said left and right roller drums, respectively; each capable of rotating the associated drum at a forward speed and at a reverse speed; a control handle assembly that extends from the frame to an operator position behind the frame, having left and right control handles each operatively coupled to the associated drive means permitting an operator to control the rotation speed of each of said drums, wherein each of said left and right drive means includes a continuous drive web situated at a respective end of said frame, and engaging a drive sprocket situated at an outboard end of the associated roller drum.

2. The power lawn roller according to claim 1, further comprising a caster wheel disposed on said frame behind said roller drums.

3. The power lawn roller according to claim 1, further comprising a weight bar situated on said frame and a plurality of removable weights supported on said weight bar.

4. The power lawn roller according to claim 3, wherein weight bar is disposed transversely and is mounted above said drums and forward of said axle.

5. The power lawn roller according to claim 1, wherein said drive means include left and right hydraulic pumps coupled to an output of said motor, and associated left and right hydraulic motors coupled to the drive webs of the respective roller drums.

6. The power lawn roller according to claim 5, wherein said hydraulic motors have speeds that are infinitely variable between a maximum forward speed and a maximum reverse speed.

7. The power lawn roller according to claim 1, further comprising safety covers situated over the drive webs at the respective left and right ends of the frame.

8. The power lawn roller according to claim 1, wherein said left and right drums are journalled on said axle with a gap therebetween, and further comprising a trailing support wheel situated on said frame behind said drums, and having a tire thereon of at least about the same width as said gap and positioned so as to press down any strip of earth that may be left by said gap.

9. A walk-behind power lawn roller that permits an operator walking behind it to control the direction and speed of travel with great precision; comprising a frame including a transverse axle; a left roller drum and a right roller drum both journalled side by side on said axle and rotatable independently of one another; a motor mounted on said frame above said roller drums; separate left and right independent drive means each powered by said motor and providing motive power to said left and right roller drums, respectively; each capable of rotating the associated drum at a forward speed and at a reverse speed; a control handle assembly that extends from the frame to an operator position behind the frame, having left and right control handles each operatively coupled to the associated drive means permitting an operator to control the rotation speed of each of said drums, wherein each of said left and right drive means includes a respective hydraulic pump that is coupled to an output of the motor, and associated hydraulic motor coupled a respective continuous drive web situated at a respective end of said frame, and engaging a drive sprocket situated at an outboard end of the associated roller drum, hydraulic hoses connecting between the hydraulic pump and the associated hydraulic motor, and linkage means connecting between the associated control handle and the respective hydraulic motor, such that the operator may control the rotation speed of each of the two roller drums, independent of each other, between a full forward speed, through a null speed, to a full reverse speed.

* * * * *